US005634174A

United States Patent [19]

Mori et al.

[11] Patent Number: 5,634,174

[45] Date of Patent: May 27, 1997

[54] DEVELOPER APPARATUS HAVING TONER CONCENTRATION CONTROL

[75] Inventors: Shingo Mori; Takashi Nagashima; Hiroyuki Hamakawa; Kiyoaki Miyamoto; Yukihiro Aikawa, all of Osaka, Japan

[73] Assignee: Mita Industrial Company, Ltd., Osaka, Japan

[21] Appl. No.: 609,542

[22] Filed: Mar. 1, 1996

[30] Foreign Application Priority Data

Mar. 7, 1995 [JP] Japan ..... 7-046798

[51] Int. Cl.[6] ..... G03G 15/08

[52] U.S. Cl. ..... 399/62

[58] Field of Search ..... 355/246, 208

[56] References Cited

U.S. PATENT DOCUMENTS 4,200,665 4/1980 Suzuki et al. ..... 355/246 X
4,974,025 11/1990 Kikuchi ..... 355/246
5,031,123 7/1991 Narukawa ..... 355/208 X
5,166,729 11/1992 Rathbun et al. ..... 355/208
5,508,793 4/1996 Kimura et al. ..... 355/246
5,519,316 5/1996 Hagiwara et al. ..... 355/208 X

*Primary Examiner*—Arthur T. Grimley
*Assistant Examiner*—Sophia S. Chen
*Attorney, Agent, or Firm*—Beveridge, Degrandi, Weilacher & Young, LLP

[57] ABSTRACT

A developer unit of the present invention has an agitating paddle which agitates a developer containing a magnetic carrier and a non-magnetic toner, and a toner is supplied from the toner hopper according to an output of a toner concentration sensor. After an agitation is finished which is performed when the power is turned on, the agitating paddle is periodically operated to agitate the developer. During the agitation, a toner concentration controller shifts a reference level with which the output of the toner concentration sensor is compared from a predetermined level to a higher level and then stepwisely returns it to the predetermined level.

12 Claims, 4 Drawing Sheets

DEVELOPER APPARATUS HAVING TONER CONCENTRATION CONTROL

BACKGROUND OF THE INVENTION

1. Field of the Invention

The present invention relates to a developer apparatus which develops an electric latent image on the surface of a photoreceptor by using a developer containing a magnetic carrier and a non-magnetic toner.

2. Description of the Prior Art

Typically, the toner concentration of a developer apparatus of this type is determined based on a result of a comparison between a predetermined reference value and a toner-to-carrier ratio in a mixture of toner and carrier detected by a permeability sensor. The output of the permeability sensor increases as the toner concentration decreases, and decreases as the toner concentration increases. Therefore, when the sensor output is higher than the reference value, toner is replenished to maintain the toner concentration constant.

It is known that when the power is turned on, the developer in the developer unit is of a small volume and is therefore of a high concentration so that the output of the sensor is high for the toner concentration. Therefore, in such a case, if the output of the sensor is used for the comparison with the reference value, toner is excessively replenished to increase the toner concentration.

To solve this problem, when the power is turned on, the reference value is set to a high value at first and then stepwisely decreased therefrom. By this method, the malfunction of the toner concentration control is tentatively avoided when the power is turned on.

In the case of an electrographic copying machine, however, after the power is turned on, the copying machine is frequently left in a copy ready condition for a long time whether copying is necessary or not. For this reason, there exists a considerable period of time during which copying is not performed (therefore, the developer unit does not operate). In such an unoperated period, the agitation is not performed in the developer unit.

For this reason, although not as apparent as when the power is turned on, the air in the developer escapes therefrom during the unoperated period to decrease the volume of the developer, so that the sensor detects the toner concentration to be lower than the actual concentration when copying is performed. If toner is excessively replenished accordingly, the toner concentration is abnormally high, so that toner may scatter or fogging may occur on images.

SUMMARY OF THE INVENTION

An object of the present invention is to provide a developer apparatus in which correct toner concentration control is ensured even after the power is turned on.

To achieve the above-mentioned object, in a developer apparatus of the present invention provided with agitating means for agitating a developer containing a magnetic carrier and a non-magnetic toner and in which a toner is replenished from a toner replenisher according to an output of a toner concentration sensor, after an agitation is finished which is performed when the power is turned on, the agitating means is periodically operated to agitate the developer.

During the agitation, a toner concentration controller of the present invention shifts a reference value with which the output of the toner concentration sensor is compared from a predetermined level to a high level and then stepwisely returns it to the predetermined level so that the toner is replenished based on a result of the comparison between the reference value and the output of the toner concentration sensor.

According to such features, although the toner concentration sensed by the toner sensor is seemingly low because of the reduction in volume of the developer due to the escape of air from the developer during the unoperated period, the reduction in volume of the developer is corrected by periodically performing aging (agitation of the developer is also performed) to agitate the developer. As a result, development is performed at an appropriate toner concentration when copying is performed after an unoperated period.

In addition, by shifting the reference level from the predetermined level to the high level during the aging and then stepwisely returning it to the predetermined level, development is performed at a more appropriate toner concentration.

BRIEF DESCRIPTION OF THE DRAWINGS

This and other objects and features of this invention will become clear from the following description, taken in conjunction with the preferred embodiments with reference to the accompanied drawings in which.

DESCRIPTION OF THE PREFERRED EMBODIMENTS

Figure 1:
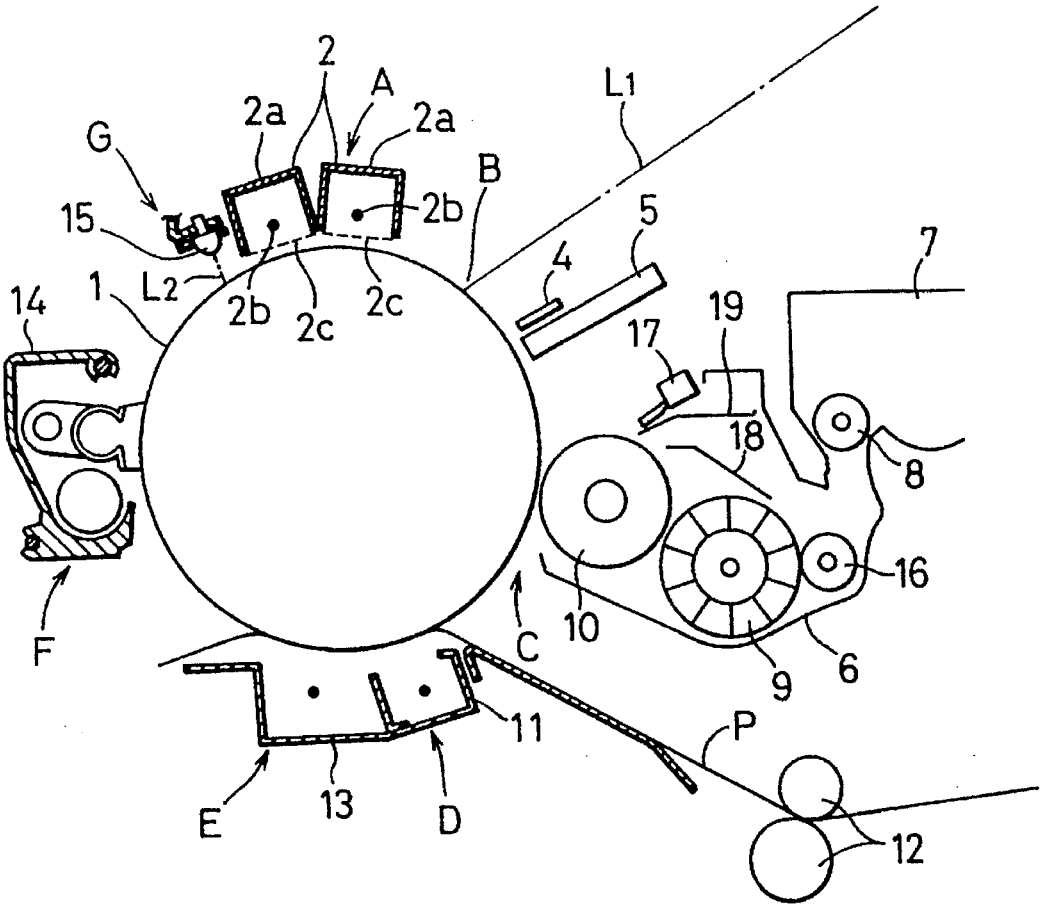
FIG. 1 is a schematic view of a relevant portion of an electrographic copying machine provided with a developer apparatus of the present invention.

Hereinafter, an embodiment in which an apparatus according to the present invention is employed for an electrographic copying machine will be described with reference to the drawings. Referring to FIG. 1, there is schematically shown the structure of the electrographic copying machine. Reference numeral 1 represents a photoreceptor drum serving as an electrostatic latent image carrier. The drum 1 includes a drum base made of a metal such as aluminum on which a selenium photosensitive material is deposited to form a photosensitive layer, and is rotated clockwise in the figure at a constant speed.

In the periphery of the drum 1, the following sections are arranged in this order along the rotation direction (movement direction) of the drum 1: a charging section A, an exposure section B, a development section C, a transfer section D, a separation section E, a cleaning section F, and a charge removal section G.

In the charging section A, a pair of chargers 2 are disposed adjacent to each other. The chargers 2 are both positioned to look toward the axial center of the drum 1 and to be close to the drum surface to face it. The surfaces of the chargers 2 which face the drum 1 are open. In each of shield cases 2*a* disposed in parallel with the drum axis, a charging wire 2b composed of a fine tungsten wire is stretched along the length of the shield case 2a, and a grid electrode 2c made of a conductive material having a plurality of openings is provided at the open surface of the shield case 2a.

Typically, a high voltage of approximately 4 to 6 kV is applied to the main wires 2b. When the high voltage is applied to the chargers 2, a corona discharge occurs to charge the drum surface. The potential of the surface of the drum 1 thus charged is normally approximately 1000 V.

When the drum 1 rotates so that the charged surface reaches the exposure section B, a reflection light $L_1$ of an original image is irradiated onto the charged drum surface through a non-illustrated optical system to expose the surface. In this case, only the surface potential of the exposed portion is reduced through optical attenuation in correspondence with the exposure amount, so that an electrostatic latent image is formed.

Just in front of the development section C, in the drum rotation direction, there is disposed a potential sensor 4. The measurement value provided by sensor 4 is used such that the charging potential of the drum surface at the development section C is kept at a target value. Since the potential of the drum surface charged at the charging section A is dark-decayed while the drum 1 is rotating to the development section C, the drum surface potential is reduced to approximately 820 V when the drum surface reaches the development section C. That is, the drum surface potential is necessarily approximately 820 V at the development section C, and the voltage applied to the chargers 2 at the charging section A is set so that the surface is charged to a potential (1000 V) allowing for the dark decay. In other words, in order that the surface potential of the drum surface at the development section C is the target value 820 V, the measurement value of the surface potential at the potential sensor 4 is necessarily 850 V. Therefore, the charging potential of the charging section A is set to a value so that the measurement value is 850 V when the value at section A is 1000 V.

Reference numeral 5 represents an image erasing blank lamp disposed adjacent to the potential sensor 4. The blank lamp 5 includes light emitting diode (LED) arrays. When the user intends to erase a part of an electrostatic latent image for a purpose such as specifying an image area, necessary LEDs are selectively turned on so that the portion of the electrostatic latent image irradiated by the LEDs which are on is optically attenuated and erased.

Disposed in the development section C are a developer unit 6 and a toner hopper 7 which supplies toner to the developer unit 6. In this arrangement, the toner contained in the toner hopper 7 is supplied into the developer unit 6 by a necessary amount through toner replenishing roller 8 which preferably is a sponge roller. The non-magnetic toner and magnetic carrier (iron powder) are agitated by an agitating roller 9 (e.g., a roller with paddles) in the developer unit 6, and the toner held by the carrier adheres to the surface of a development magnetic roller 10. When the portion of the drum 1 on which an electrostatic latent image is formed reaches the development section C, the toner in the developer unit 6 electrically adheres to the drum surface according to the electrostatic latent image through the development magnetic roller 10, thereby forming a toner image.

Disposed in the transfer section D is a transfer charger 11. When the drum 1 reaches the transfer section D, a sheet P is fed through a pair of paper feeding rollers 12 of a paper feeding section onto the drum surface, and a voltage of a polarity opposite to that of the toner is applied to the transfer charger 11 to transfer the toner image formed on the drum surface to a substrate such as sheet P. Disposed in the separation section E is a separating charger 13 which applies an alternating current (AC) electrical field to the drum surface to thereby release the sheet P from being attracted to the drum 1, so that the sheet P to which the toner image has been transferred is separated from the drum 1.

Disposed in the cleaning section F is a cleaning unit 14 which removes things such as toner adhering to the drum surface from the drum surface by scrubbing the drum surface. The residual toner on the drum surface reaches the cleaning section F and is removed by the cleaning unit 14. Then, at the charge removal section G, a charge removing light $L_2$ of a charge removing lamp 15 irradiates the drum surface to optically attenuate the surface potential of the drum 1, so that the charge is removed.

Then, the drum 1 returns to the charging section A to be ready for the next copying process. When the continuous copying is set, the above-described copying process is repeated arbitrarily set times.

Figure 2:
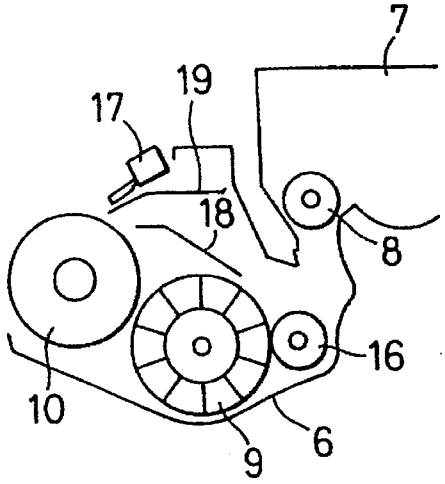
FIG. 2 is a schematic view of the developer apparatus embodying the present invention.

Referring to FIG. 2, there is shown the above-described developer unit. Reference numeral 16 represents a mixing spiral. Reference numeral 17 represents a toner concentration sensor. The toner concentration sensor 17 is a permeability sensor. Reference numeral 18 represents a partition. Reference numeral 19 represents a doctor blade.

Figure 3:
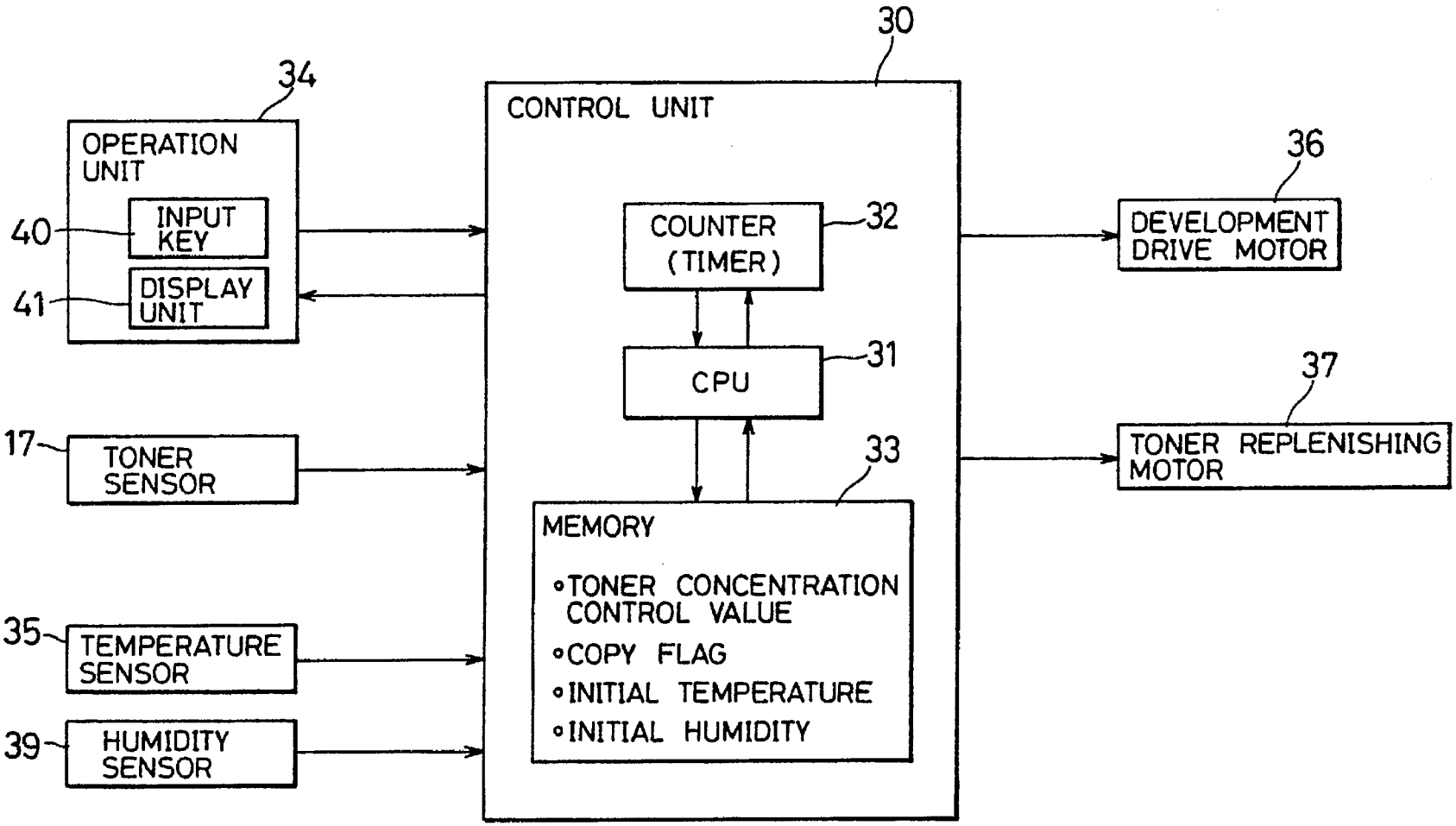
FIG. 3 is a block diagram of the developer apparatus and its toner concentration control system embodying the present invention.
Figure 4:
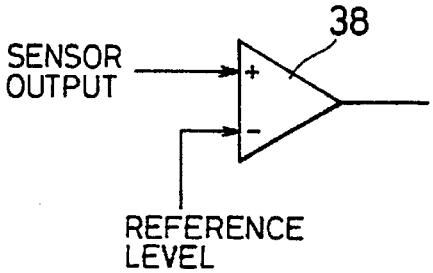
FIG. 4 shows a part of the control system as an image.

The output of the toner concentration sensor 17 is high when the toner concentration is low and low when the toner concentration is high. The output is converted into a digital value by an analog-to-digital (A/D) converter and then processed by a control unit 30 comprising a microcomputer as shown in FIG. 3 to be used to control a toner replenishing motor 37 which drives the toner replenishing roller 8. At this time, the control unit 30 compares the output of the sensor 17 with a reference level, and when the sensor output is higher than the reference level, the control unit 30 drives the toner replenishing motor 37 to supply toner from the toner hopper 7 to the developer unit 6. The control unit 30 makes the comparison through calculations, which is shown as an image in FIG. 4. Here, reference numeral 38 represents a comparator.

The control unit 30 also drives a development drive motor 36. In this case, the power of the motor 36 is used not only for rotating the agitating roller 9, the development magnetic roller 10 and the mixing spiral roller 16 but also for rotating the photoreceptor drum 1 and a fixing roller (not shown).

The control unit 30 includes a central processing unit (CPU) 31, a counter (timer) 32 and a memory 33. An operation unit 34 includes an input key 40 such as a copy key, and a display unit 41. The operation unit 34 includes a CPU (now shown) which has memory storage capability, and reception and transmission of information set by or held in the operation unit 34 is performed between the operation unit 34 and the control unit 30. Operation unit 34 also includes input key unit 40 and display unit 41.

The reference value for the toner concentration control is also stored in a memory of the operation unit and transferred to the memory 33 of the control unit 30 when the power is turned on. When the copy key of the operation unit 34 is operated, a copy flag in the memory 33 of the control unit 30 is set in response thereto.

Reference numeral 35 represents a temperature sensor which is disposed where it is not affected by the temperature in the copying machine. Therefore, the temperature sensor senses the temperature of the environment where the copying machine is placed. When the power is turned on, the detection output of the temperature sensor 35 is stored as an initial temperature in the memory 33 of the control unit 30. Reference numeral 39 represents a humidity sensor for detecting the humidity of the environment. The humidity sensor 39 is disposed in a similar manner as the temperature sensor 35. The output of the humidity sensor 39 is also stored in the control unit 30 as an initial humidity when the power is turned on.

When the power is turned on, aging is performed to place the electrographic copying machine in a copy possible condition (stable condition). In the aging, the paddle 9 and the rollers 10 and 16 rotate and the photoreceptor drum 1 and the fixing roller also rotate. When the temperature of a heating roller of the fixing roller reaches a predetermined fixing temperature, aging is finished and the rotation of all the members that rotate in the aging is stopped.

In the copy ready condition, when the copy key is depressed, the drum 1 and the fixing roller rotate and the magnet roller 10, the paddle 9 and the spiral roller 16 in the developer unit also rotate. The rotation of these members is continued until the copy operation is finished.

Figure 5:
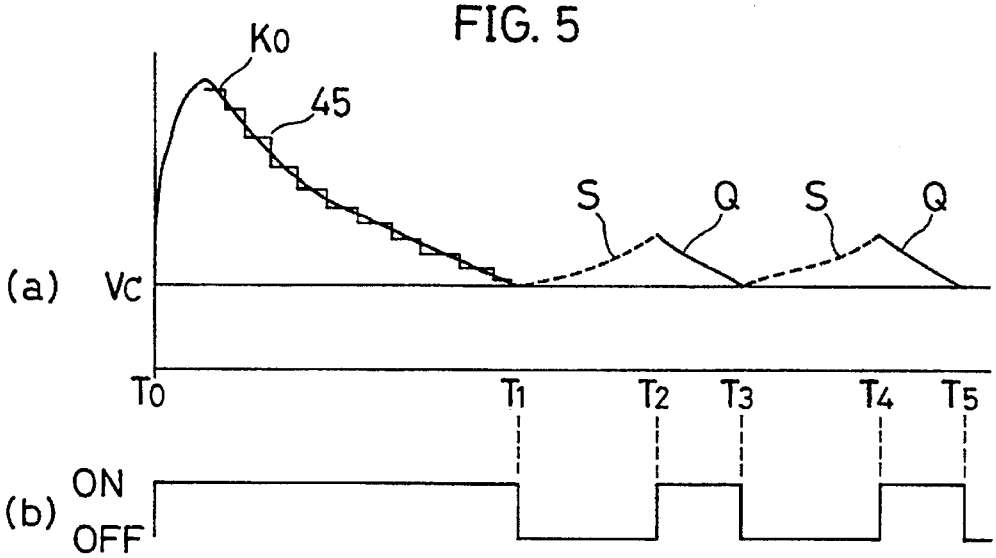
FIG. 5 is a view of assistance in explaining an operation of the control system.

The aging after the power is turned on is performed in a period from $T_0$ to $T_1$ in FIG. 5. In FIG. 5, (a) represents the output of the toner concentration sensor and the axis of abscissa represents time. (b) represents ON and OFF periods of the motor. After the power is turned on at $T_0$, the reference level of the comparator is shifted from $V_c$ to $K_0$ and stepwisely reduced therefrom to $V_c$ until the output of the sensor 17 reaches its original control value $V_c$. A step waveform 45 represents a transition of the reference value.

After aging is finished at $T_1$, the drum 1 and all other rotary members in the developer unit 6 are stopped during a period (unoperated period) when copying is not performed. However, in the present embodiment, the motor is periodically activated after $T_1$ as shown in (b) of FIG. 5 ($T_2$ to $T_3$ and $T_4$ to $T_5$) to perform aging. Since the rotary members such as the agitating paddle in the developer unit rotate for this reason, the output of the toner concentration sensor which increases as shown by the dotted line S during the unoperated period decreases as shown by the solid line Q. As a result, the malfunction of the toner concentration control is avoided when copying is performed after a long unoperated period.

When copying is performed during the periods $T_2$–$T_3$ and $T_4$–$T_5$, preferably, as is performed during the period $T_0$ to $T_1$ after the power is turned on, the reference level for the toner concentration control is shifted to a high value (where toner concentration is low) at first and then stepwisely returned to the original level $V_c$.

Figure 6:
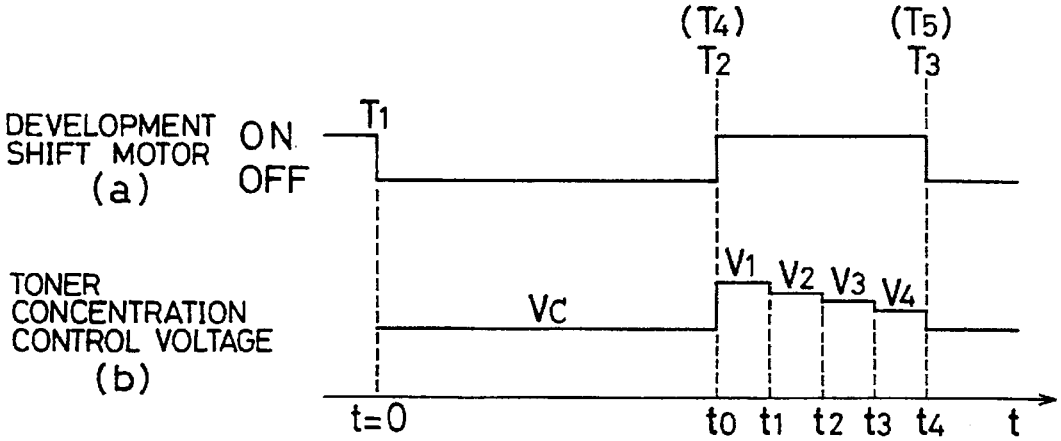
FIG. 6 is a view of assistance in explaining the operation of the control system.
Figure 7:
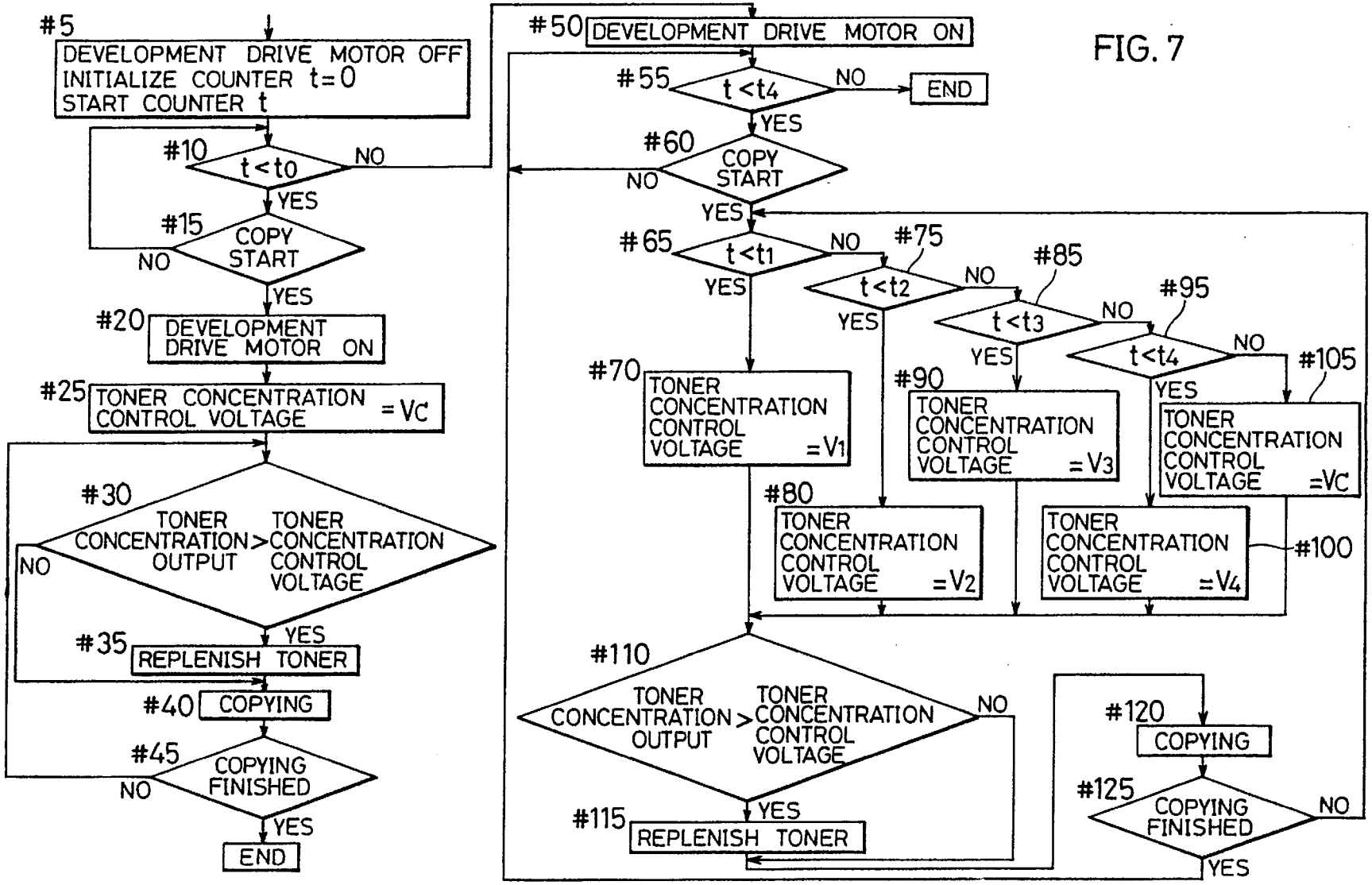
FIG. 7 is a flowchart of the operation.

Referring to FIG. 6, there is shown an example where this is performed during the period $T_2$–$T_3$ (or $T_4$–$T_5$). As shown in (b), the reference value is shifted from its original level $V_c$ to $V_1$ at $T_2$ (or $T_4$) and stepwisely returned therefrom to $V_c$ like $V_1 \rightarrow V_2 \rightarrow V_3 \rightarrow V_4 \rightarrow V_c$. FIG. 7 shows a flowchart of this operation.

Referring to FIG. 7, when the aging that is performed when the power is turned on is finished, at step #5, the control unit 30 deactivates the development drive motor 36 and resets and starts the counter 32 (i.e. initializes the counter 36 to t=0 and then causes it to start counting). At the next step #10, whether the count value of the counter has reached t0 or not is determined. When it has not reached t0, the process proceeds to step #15 to determine whether or not the copy key has been depressed to instruct the start of copying (copy start instructed condition).

When the start of copying has not been instructed, the process returns to step #10. When the start of copying has been instructed, the development drive motor 36 is activated at step #20 and the reference level (toner concentration control voltage) is set to its original level $V_c$ at step #25. Then, the process proceeds to step #30.

At step #30, whether the output of the toner concentration sensor 17 is higher than $V_c$ or not is determined. When it is higher, the toner replenishing motor 37 is driven to replenish toner at step #35. Then, the process proceeds to copying (step #40). When the output of the toner sensor 17 is lower than $V_c$, the process proceeds directly to step #40 to perform copying. Then, the process proceeds from step #40 to step #45 to determine whether copying has been finished or not. When copying has not been finished, the process returns to step #30. When copying has been finished, this flow is finished.

When the count value of the counter is t0 or higher at step #10, the process proceeds to step #50 to activate the development drive motor 36. Then, the process proceeds to the next step #55. Here, when the count value exceeds t4, this flow is finished, and when the count value is t4 or lower, whether the start of copying has been instructed or not is determined at step #60. Here, when the start of copying has not been instructed, the process returns to step #55, and when the start of copying has been instructed, the process proceeds to step #65.

At steps #65, #75, #85 and #95, which of t0 to t4 the count value of the counter has reached is determined (i.e. to which point of time the present time corresponds) to set the reference level in accordance with the present point of time (steps #70, #80, #90 and #100). Then, the process proceeds to step #110 to determine whether the output of the toner concentration sensor is higher than the set reference value or not. When it is higher, after toner is replenished at step #115, copying is performed (#120). When it is lower, the process proceeds directly to step #120 to perform copying. After step #120, the process proceeds to step #125 to determine whether copying has been finished or not. When copying has been finished, the process returns to step #55. When copying has not been finished, the process returns to #65.

While a copying process performed in the repeated aging under the unoperated condition is described in the above explanation, the process to increase the reference level at first and then stepwisely decrease it to $V_c$ may be employed for a copying process performed when aging is not performed under the unoperated condition.

As described above, according to the present invention, correct toner concentration control is ensured even when the copying machine is left unoperated for a long period of time after the power is turned on. As a result, the problem is prevented that an excessive toner replenishment increases the toner concentration to cause a scatter of toner and a fogging on images.

Obviously, many modifications and variations of the present invention are possible in light of the above teachings. It is therefore to be understood that within the scope of the appended claims, the invention may be practiced other than as specifically described.

What is claimed is:

1. A developer apparatus comprising:

a developer unit having agitating means for agitating a developer containing a magnetic carrier and a non-magnetic toner;

a toner concentration sensor which detects a toner concentration in the developer unit;

toner replenishing means for replenishing the toner into the developer unit according to an output of the toner concentration sensor;

controlling means for controlling the agitating means so as to conduct an initial agitation of the developer when power is provided to the developer apparatus so as to turn said developer apparatus on and, subsequent to the initial agitation of the developer, for periodically agitating the developer; and wherein said controlling means activates said agitating means at time intervals that are approximately equal to time intervals at which an output value from said toner concentration sensor in said developer unit reaches a predetermined value while said agitating means is deactivated, and deactivates said agitating means when the output value from the toner concentration sensor returns to around a reference value.

2. A developer apparatus according to claim 1, wherein said toner replenishing means compares the output of the toner concentration sensor with a reference level to replenish the toner based on an output of the comparison.

3. A developer apparatus according to claim 2, wherein the output of the toner concentration sensor is low when the toner is of high concentration, and high when the toner is of low concentration.

4. A developer apparatus according to claim 3, further comprising means for, when copying is performed during agitation, increasing the reference level from a predetermined value and then stepwisely returning the reference value to the predetermined value.

5. A developer apparatus according to claim 1, wherein, when a predetermined period of time has not elapsed since the initial agitation, agitation is performed only during copying.

6. A developer apparatus comprising:

a developer unit having agitating means for agitating a developer containing a magnetic carrier and a non-magnetic toner;

a toner concentration sensor which detects a toner concentration in the developer unit;

toner replenishing means for replenishing the toner into the developer unit according to an output of the toner concentration sensor; and controlling means for controlling the agitating means so as to conduct an initial agitation of the developer when power is provided to the developer apparatus so as to turn the developer apparatus on and for periodically agitating the developer subsequent to the initial agitation of the developer; and said controlling means further comprising means for, when copying is performed during agitation, increasing the reference level from a predetermined value and then stepwisely returning the reference value to the predetermined value.

7. A developer apparatus comprising:

a developer unit having agitating means for agitating a developer containing a magnetic carrier and a non-magnetic toner and said developer unit further comprising means for supplying toner to an electrostatic latent image support so as to form a toner image on said support;

transfer means for transferring the toner image on said support to a substrate;

a toner concentration sensor which detects a toner concentration in the developer unit;

toner replenishing means for replenishing the toner into the developer unit according to an output of the toner concentration sensor;

controlling means for controlling the agitating means so as to conduct an initial agitation of the developer when power is first provided to said developer apparatus, said controlling means including timer means for determining predetermined time intervals following completion of said initial agitation, and said controlling means, upon said timer means determining one of said predetermined time intervals has passed without said means for transferring being active, again activating said agitating means so as to avoid an inaccurate reading by said toner concentration sensor due to a reduction in volume of the developer which can occur due to non-operation of said agitating means over a period of time.

8. A developer apparatus according to claim 7, further comprising a copy start key for activating said developer unit and said transfer means, wherein following activation of said copy start key and before the transferring of the toner image on the substrate, said toner replenishing means compares the output of the toner concentration sensor with a reference level to replenish the toner based on an output of the comparison.

9. A developer apparatus according to claim 8, wherein said timer means includes a counter, which counts off the predetermined time intervals, and said toner replenishing means compares the output of the toner concentration sensor during said counter counting off one of said predetermined time intervals.

10. A developer apparatus according to claim 9, wherein said control means further includes means for determining a count status of said counter after a first of said time interval periods has elapsed, and, following activation of said copy start key, assigning different reference values based on the count status of said counter.

11. A developer apparatus according to claim 7, wherein the output of the toner concentration sensor is low when the toner is of high concentration, and high when the toner is of low concentration.

12. A developer apparatus according to claim 7, further comprising means for, when copying is performed during agitation, increasing the reference level from a predetermined value and then stepwisely returning the reference value to the predetermined value.

* * * * *